US010710255B2

(12) United States Patent
Crain et al.

(10) Patent No.: US 10,710,255 B2
(45) Date of Patent: Jul. 14, 2020

(54) CUSHION BACK CUTTER WITH INTERNAL BLADE HOLDER

(71) Applicant: Crain Cutter Company, Inc., Milpitas, CA (US)

(72) Inventors: Lance Darrell Crain, Pleasanton, CA (US); Tan Dinh Nguyen, Milpitas, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 96 days.

(21) Appl. No.: 15/870,935

(22) Filed: Jan. 13, 2018

(65) Prior Publication Data

US 2019/0217491 A1 Jul. 18, 2019

(51) Int. Cl.

*B26B 5/00* (2006.01)
*B26B 1/10* (2006.01)
*B26B 29/02* (2006.01)

(52) U.S. Cl.

CPC ..... *B26B 5/006* (2013.01); *B26B 1/10* (2013.01); *B26B 5/005* (2013.01); *B26B 29/02* (2013.01)

(58) Field of Classification Search

CPC ..... B26B 5/005; B26B 5/006; B26B 1/10; A47G 27/0487

USPC ..... 30/162, 280–290, 294, 299, 313–315, 30/317, 329, 339

See application file for complete search history.

(56) References Cited

U.S. PATENT DOCUMENTS 1,527,835 A * 2/1925 Burke ..... B26B 27/00 30/290
1,814,596 A * 7/1931 Hamel ..... B26B 5/006 30/286
2,091,337 A * 8/1937 Sahl ..... B44C 7/025 30/317
2,550,757 A * 5/1951 Bell ..... B26B 5/006 30/162
2,567,102 A * 9/1951 Cook ..... D03D 39/24 30/162
2,869,233 A * 1/1959 Mahoney ..... B26B 5/006 30/162
3,363,314 A * 1/1968 O'Brien ..... A47G 27/0487 30/287
3,543,400 A * 12/1970 Scott et al. ..... A47G 27/0487 30/280
3,543,401 A * 12/1970 Scott et al. ..... A47G 27/0487 30/294
3,621,573 A * 11/1971 Summers ..... B26B 5/005 30/287

(Continued)

*Primary Examiner* — Jason Daniel Prone
(74) *Attorney, Agent, or Firm* — Fenwick & West LLP

(57) ABSTRACT

A cushion back cutter includes finger holes that are shaped to make blade changes and adjustments faster and easier. The cushion back cutter includes a center plate with a recess forming a blade pocket for holding a slotted razor blade. The center plate includes a finger opening for removing a slotted razor blade. The finger opening, which may be non-circular, crosses an upper wall of the blade pocket that supports the blade. A first side plate attached to a first side of the center plate covers the blade pocket in the center plate, and includes a blade window for removing a slotted razor blade from the blade pocket of the center plate. A second side plate is attached to a second side of the center plate, which also includes a finger opening.

9 Claims, 5 Drawing Sheets

(56) References Cited

U.S. PATENT DOCUMENTS 3,844,038 A * 10/1974 Kelly et al. ..... B26B 5/005 30/314
4,026,017 A * 5/1977 Arnold ..... H02G 1/1229 30/283
4,064,627 A * 12/1977 Zanfini ..... B26B 5/005 30/287
4,148,142 A * 4/1979 Sullivan ..... B26B 5/005 30/294
4,620,368 A * 11/1986 Bowman ..... B26B 5/005 30/294
5,044,081 A * 9/1991 Nguyen ..... B26B 5/005 30/289
5,272,947 A * 12/1993 Peters ..... B26D 7/2614 83/578
5,347,719 A * 9/1994 Scharf ..... A47G 27/0487 30/294
6,029,355 A * 2/2000 Carlin ..... B26D 3/001 30/287
6,421,924 B2 * 7/2002 Anderson ..... B26B 5/005 30/287
6,647,628 B1 11/2003 Braaksma
D649,425 S * 11/2011 Bunnag ..... D8/98
8,567,075 B2 * 10/2013 Hetts ..... B26B 5/005 30/287
10,315,318 B2 * 6/2019 Spencer, Jr. ..... B26B 5/005
2005/0246903 A1 * 11/2005 Yeager ..... B26B 5/00 30/329
2006/0282956 A1 * 12/2006 Underwood ..... A47G 27/0487 30/294
2011/0265333 A1 * 11/2011 Covey ..... B26B 5/005 30/353
2012/0192434 A1 * 8/2012 Syrjala ..... B26B 5/00 30/162
2012/0304472 A1 * 12/2012 Medhurst ..... B26B 5/001 30/162

* cited by examiner

CUSHION BACK CUTTER WITH INTERNAL BLADE HOLDER

BACKGROUND

This invention relates generally to flooring tools, and in particular to cushion back cutters with an internal blade holder design.

A cushion back cutter is a tool for precisely trimming the edges of carpet seams in preparation for making the seams. Cushion back cutters generally take replaceable slotted razor blades to cut through the carpet's backing. They are produced in two designs, which differ primarily in how they hold the blades.

One design is disclosed in U.S. Pat. No. 3,543,401 to Scott. Scott's cushion back cutter has a guide plate 12 with a blade notch 20 in the middle forming a center plate, and has retaining plates 22 forming a left side plate and a right side plate. Guide plate 12 and retaining plates 22 form a blade holding pocket in the area of blade notch 20, and two slotted razor blades left hand blade 24 and right hand blade 26 can be slideably inserted through the bottom of blade notch 20. A screw 32 extends through a retaining plate 22, blade notch 20, slots 28 and 30 of left hand blade 24 and right hand bade 26 respectively, and threads into a nut 34 on the opposite retaining plate 22. When screw 32 is tightened, it clamps left hand blade 24 and right hand blade 26 at a desired extension. Either blade may extend from the carpet engaging edge 14 of guide plate 12 to a cutting position, or else be retracted into blade notch 20 to a storage position. Scott describes how with a left blade 24 extended to a cutting position, the cut made in the carpet's backing "is close to the pile on left side of the space between two adjacent rows of tufts" (col. 3, line 62-64), and that with a right blade 26 extended to a cutting position, the cut made will be close to the pile on the right side (col. 3, line 65-66). As a result, excess backing material is trimmed away, bringing the piles "into abutting relation to conceal the seam" (col. 4, lines 4-5).

The cushion back cutter of Scott has a screw 32 for holding the left hand blade 24 and right hand blade 26 at the desired extension from carpet engaging edge 14 which forms the base of the cutter. This type of cushion back cutter will be referred to herein as an "external blade holder" design because screw 32 is not a feature of the body of the cushion back cutter 10 per se, but is a separate part. If screw 32 is not tightened in nut 34, left hand blade 24 and right hand bade 26 would simply slide out of blade notch 20.

In another design, as shown in U.S. Pat. No. 6,647,628B1 to Braaksma, a cushion back cutter (carpet cutter 10) has a body enclosing left and right internal pockets. The left and right internal pockets each can hold one slotted razor blade 17 only. Guide 12 forms a center plate which has the left and right internal pockets precision machined into its left and right sides. The carpet cutter 10 additionally has left and right side plates attached to the center plate, which in conjunction with the left and right internal pockets formed in guide 12 form blade holding structure 11. When inserted within either left or right internal pockets, a left or right blade may be extended to a cutting position or retracted to a storage position. To trim the carpet's backing close to carpet tufts on the left side of two adjacent rows, the left blade is extended to a cutting position and the right blade is retracted to the storage position. To trim the carpet's backing close on the right side, the right blade is extended to a cutting position, and the left blade is retracted to the storage position.

The cushion back cutter of Braaksma will be referred to herein as an "internal blade holder" design because the blade is held by the left or right internal pockets of the center plate and the left and right side plates forming the body of the cutter. Unlike the cushion back cutter of Scott, the internal blade holder of Braaksma does not use a blade holding screw, but holds the blades by means of the left and internal pockets and side plates.

FIG. 1 shows an exploded view of a prior art cushion back cutter 1 with an internal blade holder design. A center plate 10 includes a left blade pocket 13 (shown with a dashed line) on its left side and a right blade pocket 14 on its right side. Left blade pocket 13 and right blade pocket 14 are machined recesses in center plate 10 which are slightly greater in depth than the thickness of a slotted razor blade. Center plate 10 has a right center plate finger hole 15 through center plate 10 positioned generally at an upper portion of left blade pocket 13. Similarly, center plate 10 also has a left center plate finger hole 16 though center plate 10 positioned generally at an upper portion of right blade pocket 14.

A left side plate 20 and a right side plate 30 are attached to center plate 10, normally by spot welding. Left side plate 20 has a left blade window 25 that is rectangular, and a left side plate finger hole 26. Left side plate finger hole 26 is about the same size as left center plate finger hole 16 in center plate 10, and after spot welding is positioned concentrically with left center plate finger hole 16 of center plate 10. Similarly, right side plate 30 has a right blade window 34 and a right side plate finger hole 35 which is also about the same size as right center plate finger hole 15 in center plate 10. After spot welding, right side plate finger hole 35 is also positioned concentrically with right center plate finger hole 15 in center plate 10.

When left side plate 20 and right side plate 30 are spot welded to center plate 10, a left slotted razor blade 40 is held within left blade pocket 13 of center plate 10 by left side plate 20. Right slotted razor blade 42 is held within right blade pocket 14 in center plate 10 by right side plate 30. Left blade pocket 13 of center plate 10 includes a bottom wall 17, and right blade pocket 14 of center plate 10 includes a bottom wall 18 which control how far left slotted razor blade 40 or right slotted razor blade 42 extend from the base 11 of the prior cushion back cutter 1 when in a cutting position.

After the center plate 10, left side plate 20 and right side plate 30 are spot welded together, they form a cutter body 50. A handle 60 may be fastened to cutter body 50 by passing screw 70 through handle hole 61 and through three cutter body handle holes 51, then tightening with a nut 71.

FIG. 2 shows prior art cushion back cutter 1 with the handle 60 removed from the cutter body 50, a left slotted razor blade 40 inserted within a left blade pocket 13 (both shown with dashed lines) and retracted to a storage position, and right slotted razor blade 42 inserted within a right blade pocket 14 (shown with a dashed line) and extended to a cutting position. In this configuration, right slotted razor blade 42 will trim the carpet's backing close to the right side of the space between two adjacent rows of carpet tufts.

When right slotted razor blade 42 becomes dull, it is changed by use of the forefinger and thumb in a two-step bending and dragging process. First, a forefinger is inserted from the left side of the cutter body 50 through left side plate finger hole 26 in left side plate 20, then through left center plate finger hole 16 in center plate 10, until it contacts right slotted razor blade 42 to bend it outward from the inside. Right slotted razor blade 42 must be bent outward so it can pass over a upper wall 19 of right blade pocket 14. FIG. 5 shows prior art cushion back cutter 1 as right slotted razor blade 42 is being bent outward by pressure from the tip of a forefinger 2 through left side plate finger hole 26 (FIG. 2) and left center plate finger hole 16 (FIG. 2) so right slotted razor blade 42 can pass over upper wall 19 of right blade pocket 14.

Next, as shown in FIG. 2, from the right side of cutter body 50, the thumb can drag right slotted razor blade 42 forward until it contacts a top wall 39 of right blade window 34. From there, right slotted razor blade 42 must be further bent outward, again by the forefinger, so it can pass over the second step formed by top wall 39 of right blade window 34. After right slotted razor blade 42 passes over right blade window top wall 39, it can be removed entirely from right blade window 34 by the using the thumb again to drag it out. The process is similar to remove left slotted razor blade 40 from left blade pocket 13 if it were in a cutting position.

When right slotted razor blade 42 is not in use and needs to be retracted to a storage position, again the tip of the forefinger is used to bend it outward to pass over upper wall 19 of right blade pocket 14. Afterwards, the thumb can drag right slotted razor blade 42 forward until it contacts top wall 39 of right blade window 34. The inside of the right slotted razor blade 42 will rest against the outer surface 12 of center plate 10 and is frictionally held in this position for storage.

From time to time, either slotted razor blade can get stuck in right blade pocket due to debris build up from the carpet being cut, or the gradual dulling of the slotted razor blade, which can cause the cutting edge to mushroom and hang up in the pocket. However, because the finger holes 16, 26 and 15, 35 (FIG. 2) of prior art cushion back cutter 1 are of the same diameter and about the same size as the tip of the forefinger used to bend a slotted razor blade outwards, there is not enough room for the forefinger to move to assist the thumb in dragging the slotted razor blade out of the pocket. The tip of the forefinger simply buts up against the walls of the finger holes and cannot move very far. Furthermore, when a slotted razor blade must be bent outward to a greater degree to pass a top wall of a blade window, more force must be applied to bend the blade further out. Unfortunately, the tip of the forefinger is more or less stuck at the location of the finger holes, and is therefore unable to get additional leverage.

Because the carpet that is being trimmed by the cushion back cutter is very coarse and abrasive, blade change is frequent. Furthermore, in the use of the cutter, the left and right slotted razor blades are adjusted from the storage position to the cutting position on every seam to trim the left side or the right side close to the carpet tufts, adding to the work being done by the forefinger and thumb. A better design for the shape of the finger holes could provide mechanical advantage to the fingers, making blade changes and adjustments faster and easier, and thereby improving the efficiency of the tool.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Figure 3:
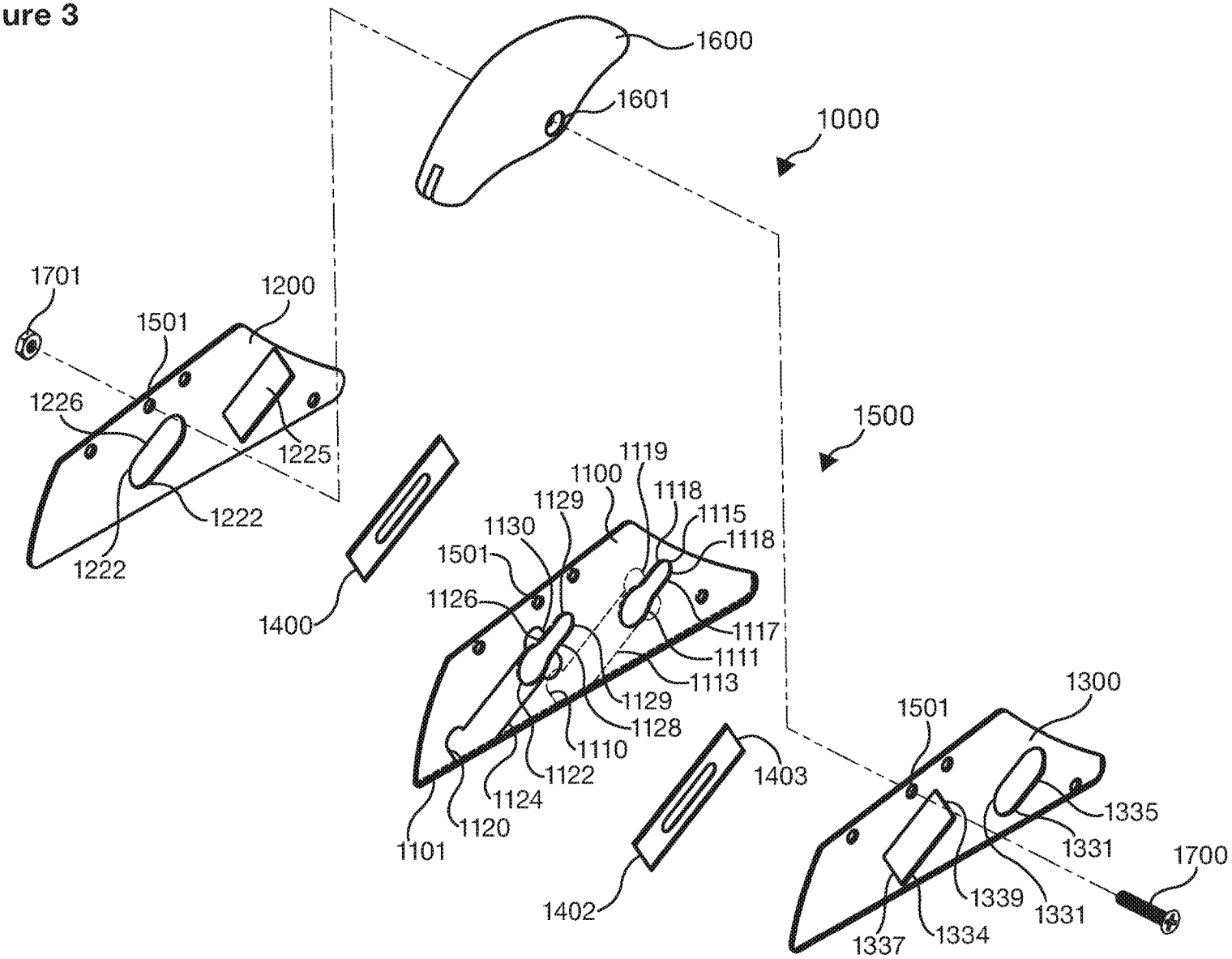
FIG. 3 is an exploded view of a cushion back cutter in accordance with an embodiment of the invention.

FIG. 3 shows a cushion back cutter 1000 with an internal blade holder design comprising a center plate 1100, left side plate 1200, right side plate 1300, left slotted razor blade 1400, right slotted razor blade 1402, handle 1600, handle screw 1700, and handle nut 1701.

Center plate 1100 includes a left blade pocket 1113 (shown with a dashed line) on its left side and a right blade pocket 1124 on its right side. Left blade pocket 1113 and right blade pocket 1124 are machined recesses in center plate 1100, which are slightly greater in depth than the thickness of a slotted razor blade. Center plate 1100 has through itself a right center plate finger keyhole 1115. Right center plate finger keyhole 1115 has a circular portion 1111 open to an extended portion 1117 having radiused corners 1118. Circular portion 1111 is positioned generally at an upper portion of left blade pocket 1113, and extended portion 1117 crosses an upper wall 1119 of left blade pocket 1113. Similarly, center plate 1100 has through itself a left center plate finger keyhole 1126 with a circular portion 1122 open to an extended portion 1128 having radiused corners 1129. Circular portion 1122 is positioned generally at an upper portion of right blade pocket 1124, while extended portion 1128 crosses an upper wall 1130 of right blade pocket 1124.

A left side plate 1200 and a right side plate 1300 are attached to center plate 1100, normally by spot welding. Left side plate 1200 has a left blade window 1225 that is rectangular, and a left side plate finger slot 1226 having radiused corners 1222. Left side plate finger slot 1226 has a width that is about the same as the diameter of circular portion 1122 of left center plate finger keyhole 1126. Furthermore, the radiused corners 1222 of left side plate finger slot 1226 form the same diameter as the diameter of circular portion 1122.

Right side plate 1300 also has a right blade window 1334 and a right side plate finger slot 1335 having radiused corners 1331. Right side plate finger slot 1335 has a width that is about the same as the width of the diameter of circular portion 1111 of right center plate keyhole 1115. Furthermore, the radiused corners 1331 of right side plate finger slot 1335 have the same radius as the radius of circular portion 1111 of right center plate finger keyhole 1115.

After spot welding, two lower radiused corners 1222 of left side plate finger slot 1226 are positioned concentrically with the circular portion 1122 of left center plate finger keyhole 1126, and two lower radiused corners 1331 of right side plate finger slot 1335 are positioned concentrically with the circular portion 1111 of right center plate finger keyhole 1115.

When left side plate 1200 and right side plate 1300 are spot welded to center plate 1100, left slotted razor blade 1400 is held in left blade pocket 1113 of center plate 1100 by left side plate 1200. Right slotted razor blade 1402 is held within right blade pocket 1124 of center plate 1100 by right side plate 1300. Left blade pocket 1113 of center plate 1100 includes a bottom wall 1110, and right blade pocket 1124 includes a bottom wall 1120 which control how far left slotted razor blade 1400 or right slotted razor blade 1402 extend from a base 1101 of cushion back cutter 1000 when in a cutting position.

After center plate 1100, left side plate 1200, and right side plate 1300 are spot welded together, they form a cutter body 1500. A handle 1600 may be fastened to cutter body 1500 by passing screw 1700 through handle hole 1601 and through three cutter body handle holes 1501, then tightening with a nut 1701.

Figure 4:
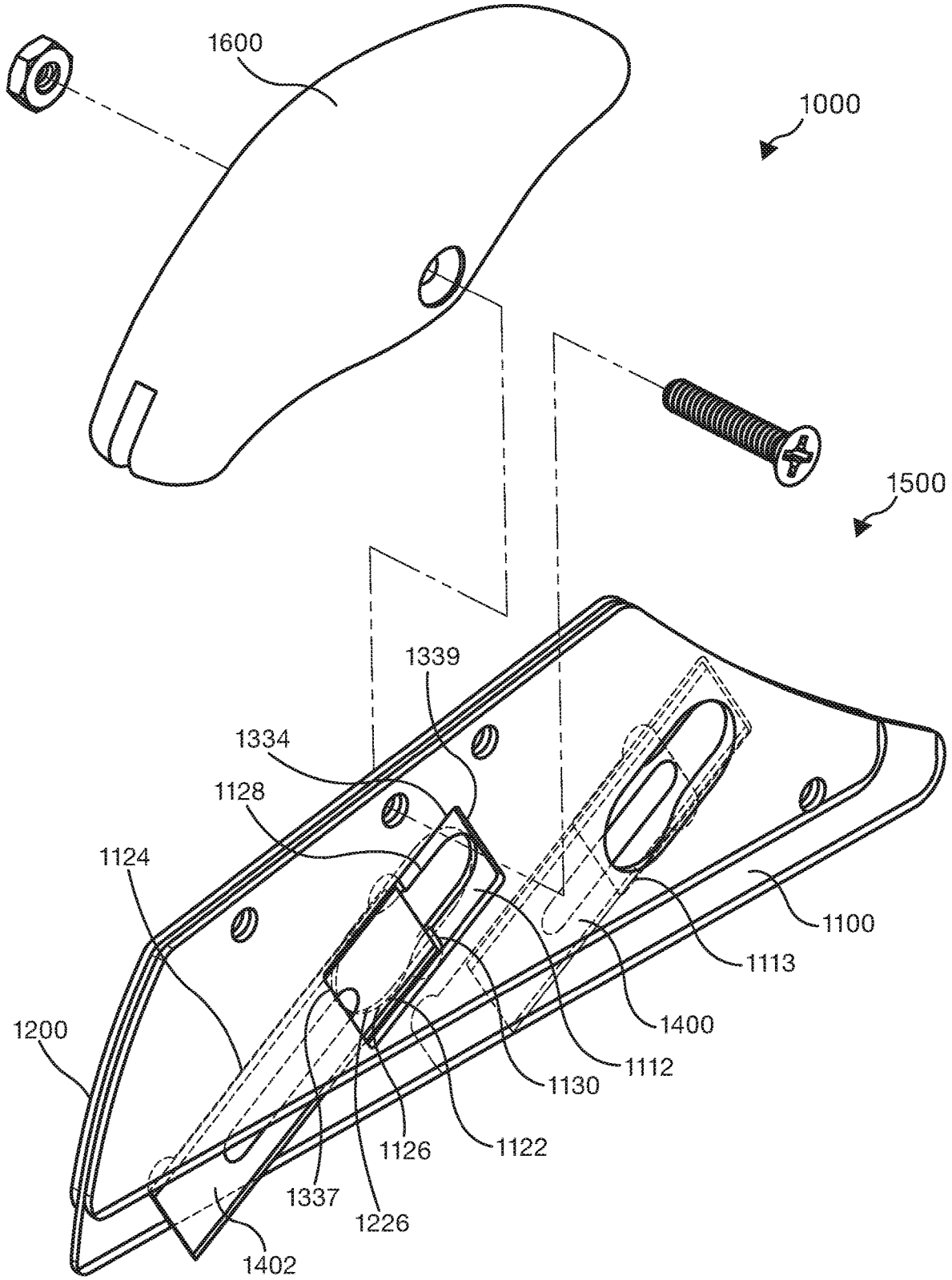
FIG. 4 is a partially exploded view of the cushion back cutter of FIG. 3.
Figure 5:
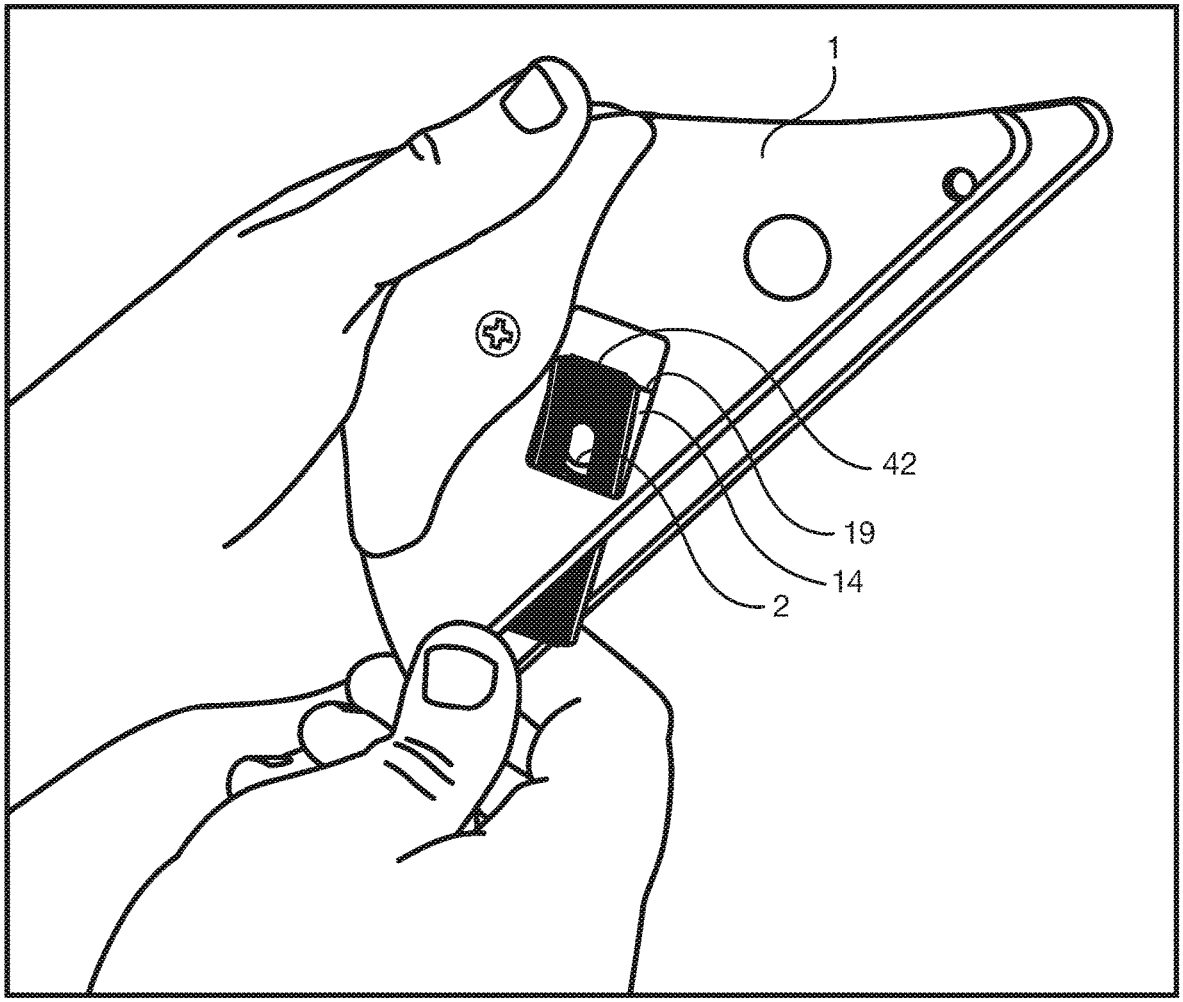
Figure 5 Prior Art
FIG. 5 shows the prior art cushion back cutter of FIG. 1 with a right slotted razor blade being bent outwards in the process of removing the blade.

FIG. 4 shows cushion back cutter 1000 with handle 1600 removed from the cutter body 1500. A left slotted razor blade 1400 is inserted within a left blade pocket 1113 (both shown with dashed lines). Left slotted razor blade 1400 is retracted to a storage position. Right slotted razor blade 1402 is inserted with a right blade pocket 1124 (shown with a dashed line), and is extended to a cutting position. In this configuration, right slotted razor blade 1402 will trim the carpet's backing close to the right side of the space between two adjacent rows of carpet tufts.

When right slotted razor blade 1402 becomes dull, it is changed by inserting a forefinger from the left side of the cutter through left side plate finger slot 1226 (shown with a dashed line) in left side plate 1200, then through left center plate finger keyhole 1126 in center plate 1000 (normally at circular portion 1122—shown also with a dashed line), until it contacts right slotted razor blade 1402 to bend it outward from the inside. Right slotted razor blade 1402 is bent outward so it can pass over a first step formed by upper wall 1130 of right blade pocket 1124.

When right slotted razor blade 1402 has been bent outward by the forefinger, both the forefinger and the thumb can drag right slotted razor blade 1402 forward (with the thumb acting from the opposite side), due to the increased clearance provided for the forefinger by extended portion 1128 of left center plate finger keyhole 1126 and the elongated shape of left side plate finger slot 1226. This permits the strength of two fingers to drag slotted razor blade 1402 forwards, rather than just one.

Once right slotted razor blade 1402 passes over upper wall 1130 of right blade pocket 1124, it must be bent outward again by the forefinger to pass over the second step formed by upper wall 1339 of right blade window 1334. Extended portion 1128 of left center plate finger keyhole 1126 allows the tip of the forefinger to push outward on slotted razor blade 1402 at a point that is further in distance from a bottom wall 1337 of right blade window 1334. This gives the tip of the forefinger greater leverage to further bend right slotted razor blade 1402 outward to pass over the second step formed by upper wall 1339 of right blade window 1334.

After right slotted razor blade 1402 passes over upper wall 1339 of right blade window 1334, both the forefinger and the thumb can drag right slotted razor blade 1402 forward to remove it completely from right blade window 1334. Both the forefinger and the thumb can drag right slotted razor blade 1402 forward, due to the increased clearance provided for the forefinger by extended portion 1128 of left center plate finger keyhole 1126 and the rounded rectangular shape of left side plate finger slot 1226. The process is similar to remove left blade 1400 from left blade pocket 1113 if it were in a cutting position.

When right slotted razor blade 1402 is not in use and needs to be retracted to a storage position, the tip of the forefinger has increased leverage to bend right slotted razor blade 1402 outward so it can pass over upper wall 1130 of right blade pocket 1124, due to extended portion 1128 of left center plate finger keyhole 1126. Afterwards, both the forefinger and the thumb can drag right slotted razor blade 1402 forward until it contacts upper wall 1339 of right blade window 1334, due to extended portion 1128 of left center plate finger keyhole 1126, providing clearance for the forefinger. The inside of the right slotted razor blade 1402 will rest against the outer surface 1112 of center plate 1100 and is frictionally held in this position for storage.

As shown in FIG. 3, the increased efficiency provided by left center plate finger keyhole 1126 and left side plate finger slot 1226 are similar if similar features are provided at blade pocket areas on either side of the tool (such as right center plate finger keyhole 1115 and right side plate finger slot 1335). The forefinger and thumb will have increased mechanical advantage in the process of changing or adjusting blades. The following explains this in terms of right center plate finger keyhole 1126 and left side plate finger slot 1226 in comparison to corresponding prior art features.

Figure 1:
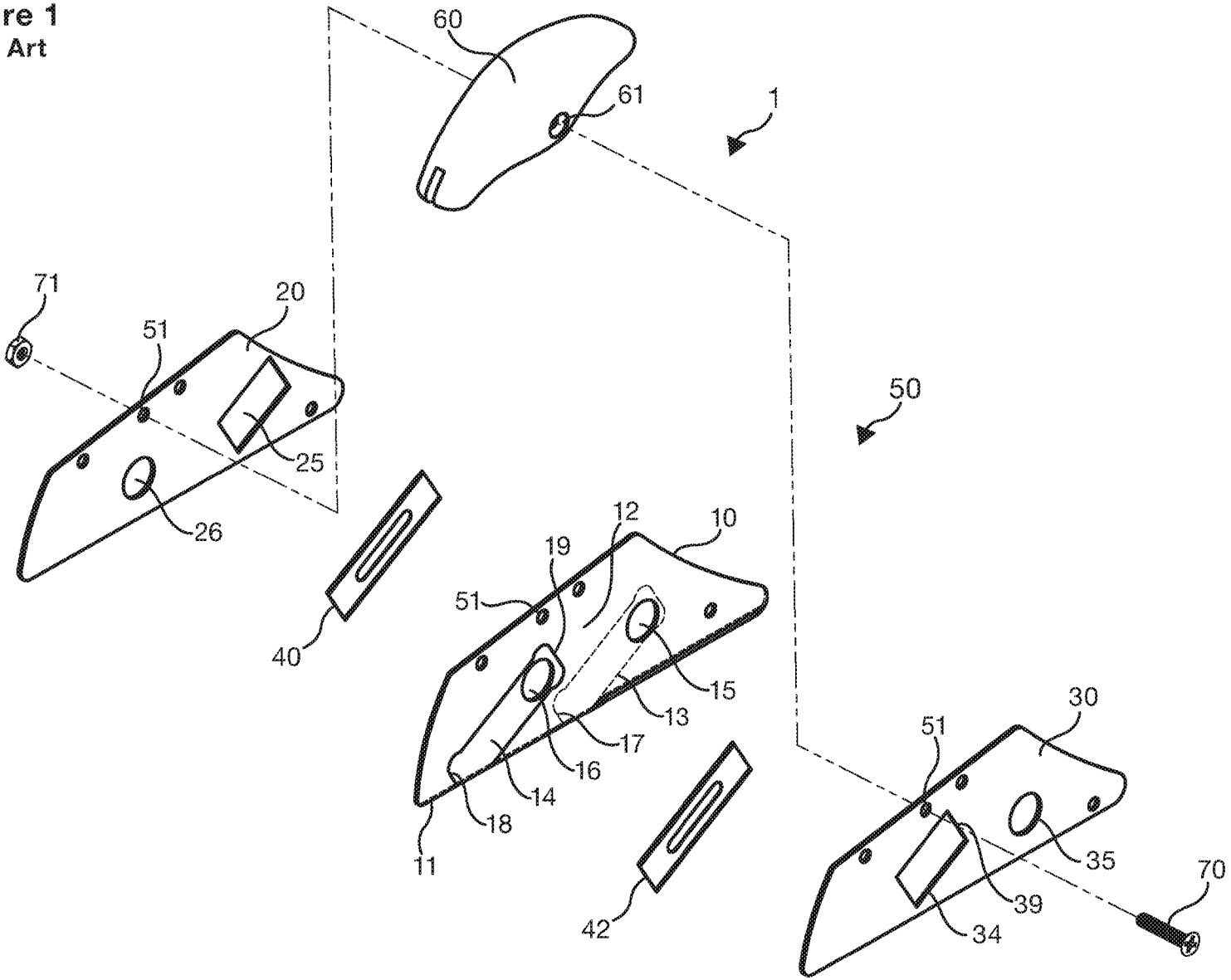
Figure 1 Prior Art
FIG. 1 is an exploded view of a prior art cushion back cutter with internal blade holder.
Figure 2:
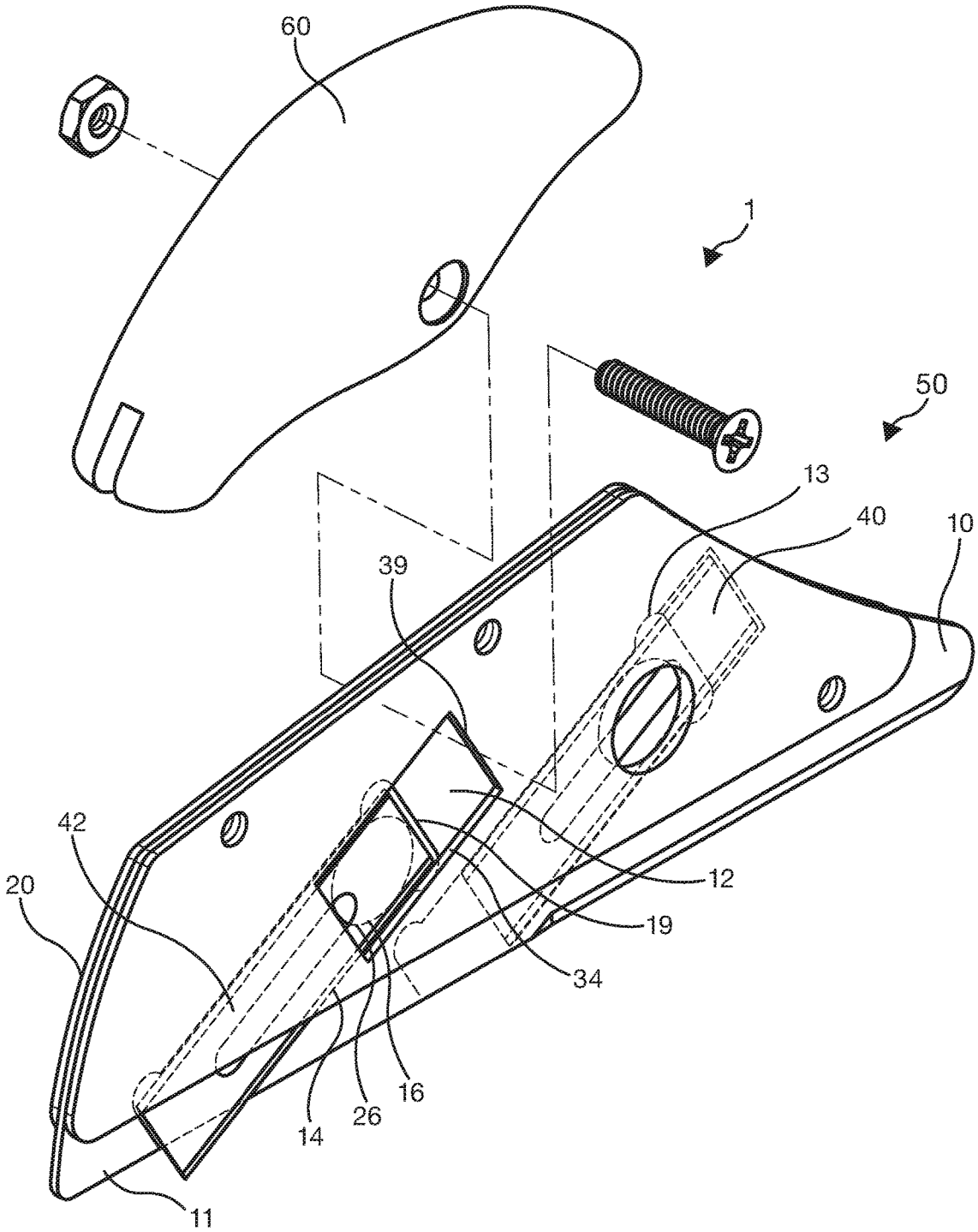
Figure 2 Prior Art
FIG. 2 is a partially exploded view of the prior art cushion back cutter of FIG. 1.

As shown in FIG. 3, to increase clearance for the forefinger, left center plate finger keyhole 1126 and left side plate finger slot 1226 could generally be any shape providing a through opening longer than the diameter of left center plate finger hole 16 and left side plate finger hole 26 of prior art cushion back cutter 1 (FIG. 1), including any non-circular shape, such as a rectangle.

However, a keyhole shape in center plate 1100 such as left center plate finger keyhole 1126 having a wide circular portion 1122 and a narrower extended portion 1128 is preferred. Circular portion 1122 should be placed in an upper portion of right blade pocket 1124, and have as large as possible a diameter as possible while remaining within the perimeter of right blade pocket 1124. If the diameter of circular portion 1122 becomes larger or is formed outside the width of right blade pocket 1124, this would notch out portions of the walls of right blade pocket 1124. This could cause right slotted razor blade to hang up on the edges of right blade pocket 1124 in the process of blade change or adjustment, which is undesirable.

Forming extended portion 1128 at a narrower width than the diameter of circular portion 1122 of center plate keyhole 1126 prevents notching out any more upper wall 1130 of right blade pocket 1124 than is necessary. Keeping more of upper wall 1130 intact helps prevent right slotted razor blade 1402 from skipping over upper wall 1130 when right slotted razor blade 1402 is forced upwards by the floor surface in the cutting action of the tool. As used herein, an upper wall of a blade pocket is the wall of the blade pocket proximate to the top of the slotted razor blade while within the blade pocket. For example, upper wall 1130 of right blade pocket 1124 is proximate the top 1403 of right slotted razor blade 1402 while within right blade pocket 1124.

Right center plate finger keyhole 1115, left center plate finger keyhole 1126, left side plate finger slot 1226, and right side plate finger slot 1335 could have square or other angled corners. However, radiused corners are preferred to eliminate sharp edges that would be uncomfortable in contact with the fingers in the process of blade change.

As used herein, any of right center plate finger keyhole 1115, left center plate finger keyhole 1126, left side plate finger slot 1226, or right side plate finger slot 1335 may be referred to as a finger opening, because a user inserts a finger through one or more of these finger openings in the process of removing or adjusting a slotted razor blade.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure. The language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A cushion back tool, comprising:

a center plate with a blade pocket for holding a slotted razor blade, the blade pocket including a wall, and the center plate further including a finger opening to allow a slotted razor blade to be bent over the wall of the blade pocket by an object placed through the finger opening, the finger opening having a portion positioned within a portion of the blade pocket, the finger opening crossing the wall of the blade pocket in the center plate;

a first side plate attached to a first side of the center plate to cover the blade pocket in the center plate, the first side plate further including a blade window for removing a slotted razor blade from the blade pocket of the center plate after the slotted razor blade is bent over the wall of the blade pocket; and a second side plate attached to a second side of the center plate, the second side plate including a finger opening.

2. The cushion back tool of claim 1, wherein the finger opening of the center plate has a keyhole shape comprising a first wider portion positioned within the portion of the blade pocket opening to a second narrower portion, and wherein the second narrower portion crosses the wall of the blade pocket of the center plate.

3. The cushion back tool of claim 2, wherein the finger opening of the second side plate is a slot having a length that is longer than its width.

4. The cushion back tool of claim 3, wherein the slot has radiused corners.

5. The cushion back tool of claim 1, wherein the finger opening of the center plate is not a circle.

6. The cushion back tool of claim 1, wherein the finger opening of the second side plate is not a circle.

7. The cushion back tool of claim 1, wherein the wall of the blade pocket in the center plate is capable of applying a force to a slotted razor blade to prevent movement of the slotted razor blade installed in the blade pocket past the wall.

8. A cushion back tool, comprising:

a center plate with a blade pocket for holding a slotted razor blade, the blade pocket including a wall, and the center plate further including a finger opening to allow a slotted razor blade to be bent over the wall of the blade pocket by an object placed through the finger opening, a portion of the finger opening positioned within a portion of the blade pocket, wherein the finger opening is not a circle, and wherein the finger opening of the center plate includes a portion that crosses the wall of the blade pocket of the center plate;

a first side plate attached to a first side of the center plate to cover the blade pocket in the center plate, the first side plate further including a blade window for removing the slotted razor blade from the blade pocket of the center plate after the slotted razor blade is bent over the wall of the blade pocket; and a second side plate attached to a second side of the center plate, the second side plate including a finger opening.

9. A cushion back tool, comprising:

a center plate with a blade pocket for holding a slotted razor blade, the blade pocket including a wall, and the center plate further including a finger opening to allow a slotted razor blade to be bent over the wall of the blade pocket by an object placed through the finger opening, a portion of the finger opening positioned within a portion of the blade pocket, wherein the finger opening is not a circle, and wherein the finger opening of the center plate has a keyhole shape comprising a first wider portion opening to a second narrower portion, and wherein the second narrower portion crosses the wall of the blade pocket in the center plate;

a first side plate attached to a first side of the center plate to cover the blade pocket in the center plate, the first side plate further including a blade window for removing the slotted razor blade from the blade pocket of the center plate after the slotted razor blade is bent over the wall of the blade pocket; and a second side plate attached to a second side of the center plate, the second side plate including a finger opening.

* * * * *